United States Patent [19]

Bates

[11] Patent Number: 4,874,125

[45] Date of Patent: Oct. 17, 1989

[54] FOLDING CORRUGATED BOARD CARTON

[75] Inventor: Howard M. Bates, Forest Hills, N.Y.

[73] Assignee: CALPAC Incorporated, Uniondale, N.Y.

[21] Appl. No.: 243,328

[22] Filed: Sep. 12, 1988

[51] Int. Cl.[4] ..... B65D 5/02

[52] U.S. Cl. ..... 229/132; 229/918; 229/DIG. 2; 229/DIG. 11; 229/186

[58] Field of Search ..... 229/186, 189, 48 R, 229/48 SA, 48 SB, 48 SC, 915, 918, 919, DIG. 2, DIG. 11, 132; 206/626

[56] References Cited

U.S. PATENT DOCUMENTS

| | | | |
|---|---|---|---|
| 1,152,844 | 9/1915 | Rexford | 229/132 |
| 1,718,204 | 6/1929 | Lupton | 229/41 |
| 1,817,045 | 8/1931 | Tanner | 229/31 R |
| 1,859,861 | 5/1932 | Ballou | 229/53 |
| 2,053,116 | 9/1936 | Sperry | 229/87 R |
| 2,120,902 | 6/1938 | Moore | 93/60 |
| 2,296,951 | 9/1942 | Rosen et al. | 229/87 R |
| 2,514,587 | 7/1950 | Nugent | 229/919 |
| 2,677,492 | 5/1954 | Buttery | 229/31 |
| 2,704,183 | 3/1955 | Stern | 229/53 |
| 2,707,553 | 5/1955 | Yount | 206/65 |
| 2,792,166 | 5/1957 | Brooks | 229/48 R |
| 3,110,434 | 11/1963 | Linda et al. | 206/626 |
| 3,144,979 | 8/1964 | Young | 229/41 |
| 3,162,351 | 12/1964 | Rudofski | 229/918 |
| 3,297,232 | 1/1967 | Fesco | 229/53 |
| 3,650,298 | 3/1972 | Delmar | 53/22 |
| 3,695,508 | 10/1972 | Hocking | 229/DIG. 3 |
| 3,810,574 | 5/1974 | Gardner | 229/31 R |
| 4,096,987 | 6/1978 | Rodish | 229/DIG. 4 |

FOREIGN PATENT DOCUMENTS

| | | | |
|---|---|---|---|
| 668596 | 12/1965 | Belgium | 229/48 SA |
| 325004 | 2/1935 | Italy | 229/DIG. 4 |
| 108012 | 2/1943 | Sweden | 229/48 R |

*Primary Examiner*—Gary Elkins

*Attorney, Agent, or Firm*—Dilworth & Barrese

[57] ABSTRACT

A folding carton formed from a one-piece blank of corrugated board is provided with vertically extending corner gusset elements which impart substantially increased vertical crush strength thereto.

10 Claims, 2 Drawing Sheets

FOLDING CORRUGATED BOARD CARTON

BACKGROUND OF THE INVENTION

This invention is directed to a rigid folding carton, container, or box, formed from a one-piece blank of corrugated board and which is suitable for both the shipping and display of its contents. More particularly, this invention relates to such a carton possessing corner gusset elements extending substantially the full height of the expanded carton, said gusset elements imparting significantly increased vertical crush strength to the carton compared with the crush strength of essentially the same carton but one lacking said gusset elements.

A common type of folding, expandable, or knock-down carton is formed from a single blank of foldable corrugated board material and possesses four wall panels, the fourth of which possesses a tab, or strip, to provide a surface of attachment for an adjacent portion of the first wall panel, a bottom flap hingedly connected to the bottom of each of the four wall panels and a top, cover, or lid flap hingedly connected to the top of each of the four wall panels such that upon expansion of the carton, the four bottom and four top flaps come together to form, respectively, the bottom and the top, cover, or lid, of the carton.

The vertical crush strength of the aforedescribed common folding corrugated board is relatively modest and care must be taken to avoid vertically stacking so many of the filled cartons as will exceed the vertical crush strength of the individual units.

A number of arrangement are available for increasing the vertical crush strength of a folding container beyond the limits of the ordinary corrugated board carton. One of them, referred to as internal packaging, involves the use of die-cut corrugated board elements for providing additional crush strength. The manufacture of internal packaging is relatively labor intensive and involves greater material costs, factors which have tended to limit its application.

Other expedients which can be used to achieve increased crush strength include modifying such parameters of corrugated board construction as the weight of the paperboard and simply multiplying the layers of corrugated board, e.g., to provide a double-wall, triple-wall, etc., structure.

Yet another arrangement for increasing vertical crush strength in a corrugated board carton lies in the provision of two, three or more separate pieces from which the carton blank is fabricated. The specialized nature of the carton and the fact that two or more separate components are involved in its construction accounts for the limited application of this approach to carton design and manufacture. Expensive machinery is required for the assembly of a multi-piece carton and relatively low manufacturing rates, e.g., 1,000 units per hour and even less in the larger carton sizes, is fairly typical. Unsightly glued flaps on external panels, readily visible coarse perforated scores and a lack of full panels which might otherwise be used to effectively display product identification are among the negative characteristics of this type of container which tend to militate against its use for point of purchase displays.

Each of these solutions to the problem of inadequate vertical crush strength exacts a considerable economic penalty. In addition, the bulk of the corrugated board required to achieve the desired increased vertical crush strength makes machining of the board more difficult and detracts from its overall appearance, an obstacle to its use in cartons intended for point of purchase display.

SUMMARY OF THE INVENTION

In accordance with the present invention, a rigid folding carton suitable for the shipping of goods and their point of purchase display is formed from a one-piece blank of corrugated board which possesses at least one structural strength-enhancing element positioned at the juncture of any two separate wall panels and/or the juncture of any wall panel and associated top and/or bottom flap member and extending for substantially the full length of said juncture.

The expression "gusset element" as used herein and in the appended claims refers to any vertical crush strength-enhancing structural element positioned at the juncture, i.e., the corner, of any two adjacent wall panels and which can be formed from a one-piece carton-forming blank.

As a result of its corner gusset elements which impart great vertical crush strength, a carton assembled from the one-piece blank of this invention possesses a number of advantages compared with known corrugated board containers such as those described above.

In addition to its capability for accepting superior display graphics, the one-piece carton of this invention is simpler to manufacture, uses less material in its construction and minimizes waste. For example, where an average of 1,000 units per hour of the multi-piece carton referred to above is typical, 5,000 units per hour of the present carton blank is readily achievable for a comparable investment in machinery and labor.

Since common manufacturing practice allows for 10% production over, and 5% production less, than the stated amount of an order, the practical consequence of such a situation is to fix the actual number of units of a multi-piece carton which are available for filling as the lowest number for a particular carton component shipped. For example, for an order of 100,000 units comprising individual pieces A, B and C, it would be usual to ship, say, 98,000 pieces A, 107,000 pieces B and 110,000 pieces C, the number of cartons available for filling thus being 98,000 (other possible losses not being taken into account).

The "extra" pieces of B and C would be warehoused to balance future production runs assuming, of course, there were no carton design changes which would render them useless. In the case of the one-piece carton blank of this invention, shipment of 98,000 carton blanks would result in that number of blanks being available for filling, no more and no less.

And, unlike a multi-piece carton, the different pieces of which must be shipped on different skids and then assembled on-site employing fairly expensive machinery, the single-piece carton blank herein is easily shipped and expanded utilizing relatively low-cost, high production volume equipment.

For a given volume, the corner-gusseted carton of the present invention may utilize a good deal less, e.g., approximately 20% by weight less, material than a conventional carton for an equivalent degree of vertical crush strength. For example, the carton of this invention can utilize 150 pound test corrugated board compared with 200 pound test board for a known type of carton to provide a carton of equivalent size but much greater vertical crush strength than the latter.

The low cost and aesthetically pleasing appearance of the high vertical crush strength folding corrugated board carton of this invention make it an ideal shipping and point of purchase display container for a wide variety of consumer goods where vertical stacking of numerous units is likely to be encountered.

BRIEF DESCRIPTION OF THE DRAWINGS

In the attached figures of drawing in which like reference numerals designate like elements throughout.

DESCRIPTION OF THE PREFERRED EMBODIMENTS

As shown in FIGS. 1–4, there is provided in accordance with this invention a folding carton blank shown generally at 10 formed from a single sheet of corrugated board of rectangular shape possessing four wall panels 11*a* and 11*b* corresponding to left and right side wall panels, respectively, and 12*a* and 12*b*, corresponding to the front end wall and rear end wall panels, respectively. The wall panels are joined together through second, third and fourth corner gusset element-forming panels 13, 14 and 15, respectively, which are subdivided along the lines of the perforations shown into sub-panels 13*a*, 13*b*, 14*a*, 14*b*, 15*a* and 15*b*, respectively. The free end of wall panel 11*a* is provided with a first corner gusset element-forming first extension panel 16*a* and in similar fashion, the free end of wall panel 12*b* is provided with a first corner gusset element-forming second extension panel 16*b*. Panels 13, 14, 5, 16*a* and 16*b* are shown to be coextensive with the height x of the wall panels so as to achieve maximum vertical crush strength but can be somewhat less than dimension x and still impart substantial vertical structural strength to the assembled carton.

Carton blank 10 further possesses top closure flaps 17*a* and 17*b*, top dust flaps 18*a* and 18*b*, bottom closure flaps 19*a* and 19*b* and bottom dust flaps 20*a* and 20*b* hingedly connected to their respective wall panels.

Figure 3:
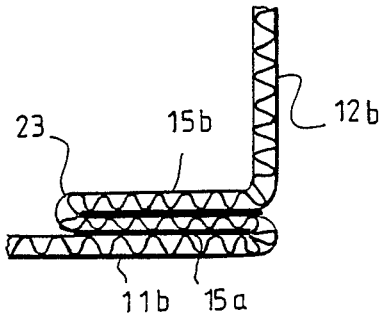
Figure 8:
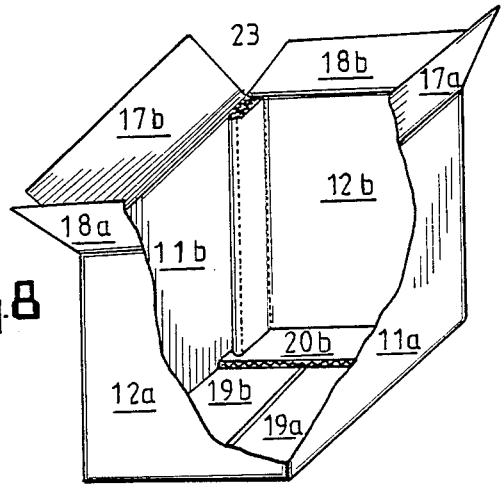

To assemble carton blank 10 into a carton which is ready for filling, a suitable adhesive such as any of those known or used for the joining of corrugated board surfaces is applied to the top surfaces of first extension panel 16*a* and each of sub-panels 13*a* 14*b* and 15*a* and to the bottom surfaces of second extension panel 16*b* and each of sub-panels 13*b*, 14*a* and 15*b*. The carton blank is then folded along the solid lines and perforations shown to form a rectangular box-shaped unit 10*a* as shown in FIG. 8. Fourth corner gusset element 23 shown in FIG. 3 is formed by folding panel 15 in the manner shown in FIG. 2. Contact of sub-panel 15*a* with the adjacent portion of wall panel 11*b* and contact of sub-panel 15*a* with sub-panel 15*b* forms single corner gusset element 23.

Figure 4:
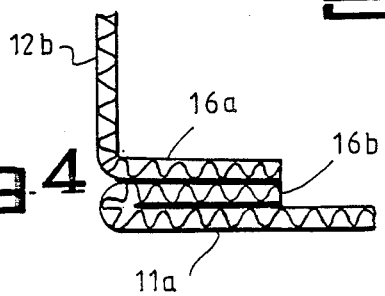
FIG. 4 illustrates, in plan view, the details of construction of the first corner gusset element.

Formation of the second and third corner gusset elements (shown unassembled in FIG. 1) are accomplished in a manner similar to that of fourth corner gusset element 23. The structure of first corner gusset element 21 is shown in FIG. 4 but unlike the second, third and fourth corner gusset elements, the components of the first corner gusset element are provided by extension panels at both ends of the blank. Thus, panel extension 16*a* is folded over and adhesively joined at its underside to a portion of wall panel 11*a* and extension panel 16*b* is folded and adhesively joined to the back, or underside, surface of extension panel 16*a* to provide the finished gusset element and the closure of the four wall panels.

Figure 5:
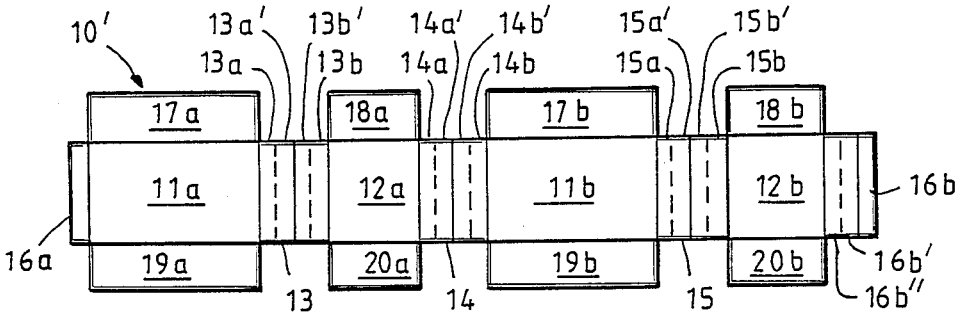
FIG. 5 illustrates, in plan view, a folding carton blank in accordance with the invention possessing a double gusset element for each of the four corners of the carton assembled therefrom.
Figure 6:
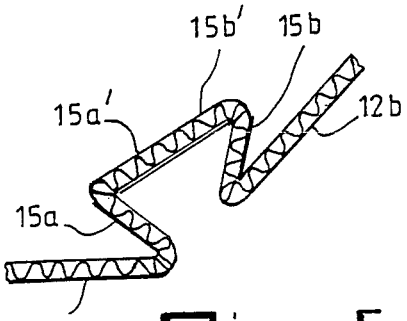
FIGS. 6 and 7 illustrate, in plan view, the folding and the gluing, respectively, of the fourth double gusset element-forming panel of the folding carton blank of FIG. 5; and, FIG. 8 is a three-dimensional view of a carton assembled from the blank of FIG. 1 with a portion of the carton cut away to show the fourth corner gusset element illustrated in FIG. 4.
Figure 7:
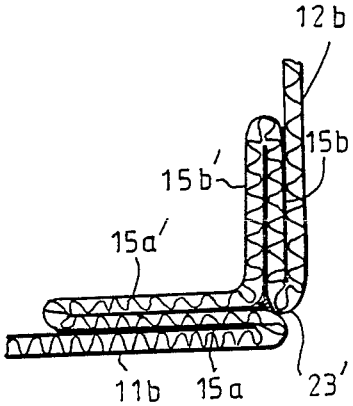

In the embodiment of the invention shown in FIGS. 5 to 7, the extension panel provided at the free end of wall panel 12*b* and gusset-forming panels 13, 14 and 15 of carton blank 10' have been modified to provide a greater number of sub-panels, i.e., 13*a*, 13*a'*, 13*b*, 13*b'*, 14*a*, 14*a'*, 14*b*, 14*b'*, 16*b*, 16*b'* and 16*b''* which, when folded and joined in the manner indicated in FIGS. 6 and 7, form double corner gusset elements. Application of adhesive is to the top of extension panel 16*a* and sub-panels 13*a* and 13*b*, 14*a* and 14*b*, 15*a* and 15*b* and 16*b''*and to the bottom of extension sub-panels 16*b* and 16*b''*and sub-panels 13*a'*and 13', 14*a'*and 14*b'*and 15*a'*and 15*b'*. Formation of a double corner gusset element is shown in FIGS. 6 and 7. Thus, e.g., panel 15 is folded and adhesively joined in the manner shown to provide fourth double corner gusset element 23'. Formation of first, second and third double corner gusset elements is accomplished in a manner analogous to that described above in connection with the carton of FIGS. 1 to 4.

While it is readily apparent that the carton blank herein can be assembled into a finished carton by hand, the invention contemplates the use of known and conventional high production rate gluing and folding machinery for final assembly of the blank into container units ready for filling.

It will be noted that the carton blank of this invention and the resulting carton do not allow for the placement of a gusset element anywhere other than at a corner, i.e., anywhere other than at the juncture of two panels. Stated another way, the carton of the present invention excludes any arrangement wherein a gusset, or vertical-strengthening member, is positioned at some point along a wall panel which is at a distance away from either of its corners. This limitation is critical to the practical assembly of the carton since it is necessary that the top and bottom flaps be freely closable without the hindrance that a gusset extending across them as well as the wall panels to which they are hingedly connected would necessarily impose. In addition, for a carton possessing a knock-out section to permit display of its contents, an important embodiment of the present invention, it is necessary that the gusset elements be positioned away from the knock-out sections.

In addition to the specific embodiments of the invention shown herein, numerous modifications thereof which are within the scope and spirit of the invention are also contemplated. Thus, for example, in place of the four-sided carton shown, a carton can be provided with three walls or more than four walls with each corner possessing a vertical crush strength-enhancing gusset element. In addition to, or in place of, internally arranged single and/or double corner gusset elements, the carton blank of the present invention, and consequently the resulting assembled carton, can possess one or more externally arranged corner gusset elements, the number and positioning of such gusset elements being simply a matter of arranging the gluing and folding pattern of the gusset element-forming panels to meet the desired design objective. Gusset elements of varying thicknesses of corrugated board can be provided, again, by varying the gluing and folding pattern of the gusset-forming panels in accordance with a predetermined pattern. The corner gusset elements can be essentially flat in appearance, the result of being built up from folded-over layers of corrugated board as shown in the embodiments of FIGS. 1–8, or they can be so constructed as to provide a hollow shaft, or post, of, e.g., square, rectangular or triangular cross section. Individual gusset element can be joined to either adjacent panel according to the requirements of a specific design.

It is also within the scope of the present invention to provide a folding corrugated board carton possessing one or more stiffening elements, structurally identical with the vertically arranged gusset elements described above except for being oriented in the longitudinal direction, e.g., the direction which is perpendicular to carton height dimension X. Such stiffening elements, which will extend for substantially the entire length of the longitudinal direction (length and/or width), can be provided by a gluing and folding arrangement applied to one or more of the top and/or bottom flaps in a manner which is analogous to that described above in connection with the formation of the corner gussets elements.

Figure 1:
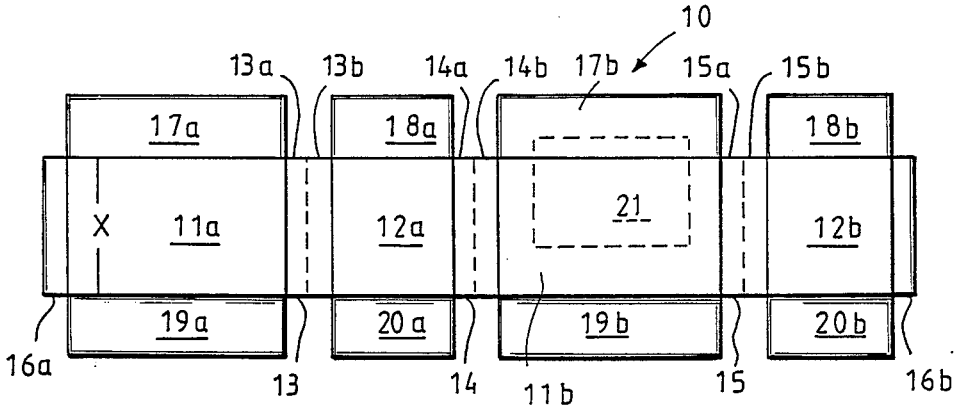
FIG. 1 illustrates, in plan view, a folding carton blank in accordance with the invention possessing a single gusset element for each of the four corners of the carton assembled therefrom.
Figure 2:
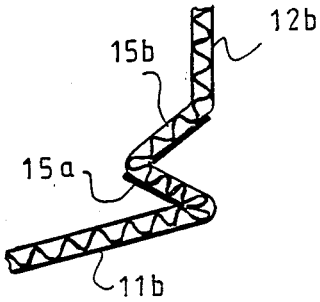
FIGS. 2 and 3 illustrate, in plan view, the folding and the gluing, respectively, of the fourth single gusset element-forming panel of the folding carton blank of FIG. 1.

As previously indicated, one or more wall panels can be provided with knock-out, or other otherwise removable, sections, e.g., section 21 shown in dotted outline in FIG. 1, to expose the contents of the carton for point of purchase display purposes without any appreciable loss of vertical crush strength.

What is claimed is:

1. A rigid folding carton suitable for the shipping of goods and their point-of-purchase display which is formed from a one-piece blank of corrugated board, which blank comprises:

a) at least three closure-forming wall panels each possessing a length dimension and each possessing an identical height dimension, the exterior surface of each wall panel being continuously flat for substantially its full expanse, the first and last of said wall panels in the series each terminating in a foldable extension panel which is substantially coextensive with the height of the panel, each wall panel being joined to a successive wall panel in the series through a foldable bridging panel which is substantially coextensive with the height of the thus-joined wall panels; and, b) at least one closure flap hingedly connected to the top or bottom of one of said wall panels, the exterior surface of the closure flap being continuously flat for substantially its full expanse, such that in the assembled condition of the carton, the foldable extension panel of the first wall panel is folded 180° and joined to the wall panel of which it is an extension, the foldable extension panel of the second wall panel is folded at an angle which is equal to 360° divided by the number of wall panels and as folded, is joined to the free surface of the folded extension panel of the first wall panel to form an internal vertical corner gusset element which is substantially coextensive with the height of the wall panels and each bridging panel joining successive wall panels is folded into subpanels which are joined to each other and to a portion of an adjacent wall panel to provide another internal vertical corner gusset element which is substantially coextensive with the height of the wall panels, the total number of said internal corner gusset elements being equal to the total number of wall panels, said internal vertical corner gusset elements imparting substantially increased vertical crush strength to said carton compared to a carton of the same dimensions and same grade corrugated board lacking vertical corner gusset elements.

2. The carton of claim 1 possessing at least four wall panels, a closure flap hingedly connected to the top of at least one wall panel and substantially coextensive with the length of such wall panel and a closure flap hingedly connected to the bottom of at least one wall panel and substantially coextensive with the length of such wall panel.

3. The carton of claim 1 possessing four wall panels, a closure flap hingedly connected to the top of each wall panel and substantially coextensive with the length thereof and a closure flap hingedly connected to the bottom of each wall panel and substantially coextensive with the length thereof, the closure flaps connected to the tops of the wall panels and the flaps connected to the bottoms of the wall panels forming, respectively, top and bottom carton closures.

4. The carton of claim 1 possessing double corner gusset elements.

5. The carton of claim 2 possessing double corner gusset elements.

6. The carton of claim 3 possessing double corner gusset elements.

7. The carton of claim 1 in which at least one wall panel possesses a removable section which on removal exposes the contents of the carton.

8. The carton of claim 2 in which at least one wall panel possesses a removable section which on removal exposes the contents of the carton.

9. The carton of claim 3 in which at least one wall panel possesses a removable section which on removal exposes the contents of the carton.

10. The carton of claim 4 in which at least one wall panel possesses a removable section which on removal exposes the contents of the carton.

* * * * *